US006607874B2

(12) United States Patent
Ihama et al.

(10) Patent No.: US 6,607,874 B2
(45) Date of Patent: Aug. 19, 2003

(54) SILVER HALIDE PHOTOGRAPHIC EMULSION AND SILVER HALIDE PHOTOGRAPHIC LIGHTSENSITIVE MATERIAL USING THE SAME

(75) Inventors: Mikio Ihama, Minami-Ashigara (JP); Genichi Furusawa, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/955,437

(22) Filed: Sep. 19, 2001

(65) Prior Publication Data

US 2002/0061482 A1 May 23, 2002

(30) Foreign Application Priority Data

Sep. 19, 2000 (JP) ..... 2000-284188
Jan. 11, 2001 (JP) ..... 2001-003901
Aug. 17, 2001 (JP) ..... 2001-248120

(51) Int. Cl.[7] ..... G03C 1/005; G03C 1/035
(52) U.S. Cl. ..... 430/567; 430/569
(58) Field of Search ..... 430/567, 569

(56) References Cited

U.S. PATENT DOCUMENTS 5,494,789 A 2/1996 Daubendiek et al.
5,792,601 A * 8/1998 Edwards et al. ..... 430/567
5,919,611 A * 7/1999 Maruyama ..... 430/567
6,007,977 A * 12/1999 Nishikawa ..... 430/567
6,045,984 A * 4/2000 Hoshino ..... 430/504
6,090,535 A * 7/2000 Morimura ..... 430/567
6,100,019 A * 8/2000 Brust et al. ..... 430/569
6,338,940 B1 * 1/2002 Miyazawa et al. ..... 430/505

FOREIGN PATENT DOCUMENTS

| | | |
|---|---|---|
| JP | A8069069 | 3/1996 |
| JP | A8101472 | 3/1996 |
| JP | A8101473 | 3/1996 |
| JP | A8101474 | 3/1996 |
| JP | A8101475 | 3/1996 |
| JP | A8101476 | 3/1996 |
| JP | A8171162 | 3/1996 |
| JP | A8171163 | 3/1996 |

* cited by examiner

*Primary Examiner*—Mark F. Huff
*Assistant Examiner*—Amanda C. Walke
(74) *Attorney, Agent, or Firm*—Birch Stewart Kolasch & Birch LLP

(57) ABSTRACT

A silver halide photographic emulsion, wherein at least 70% of the total projected area of silver halide grains contained therein is occupied by silver bromochloroiodide hexagonal epitaxial tabular grains each having (111) faces as main planes and an epitaxial protrusion portion, wherein the epitaxial protrusion portion exists on at least one apex portion of the hexagon, and, when an average silver chloride content of the epitaxial protrusion portions of all the grains having the epitaxial protrusion portion is expressed as CL mol %, a silver chloride content of each epitaxial protrusion portion of each grain falls within the range of 0.7 CL to 1.3 CL.

24 Claims, 3 Drawing Sheets

SILVER HALIDE PHOTOGRAPHIC EMULSION AND SILVER HALIDE PHOTOGRAPHIC LIGHTSENSITIVE MATERIAL USING THE SAME

CROSS-REFERENCE TO RELATED APPLICATIONS

This application is based upon and claims the benefit of priority from the prior Japanese Patent Applications No. 2000-284188, filed Sep. 19, 2000; No. 2001-003901, filed Jan. 11, 2001; and No. 2001-248120, filed Aug. 17, 2001, the entire contents of all of which are incorporated herein by reference.

BACKGROUND OF THE INVENTION

1. Field of the Invention

The present invention relates to a silver halide photographic emulsion and a silver halide photographic lightsensitive material using the same. More specifically, it relates to a silver halide photographic emulsion of a high sensitivity and a hard gradation, and a silver halide photographic lightsensitive material using the same.

2. Description of the Related Art

The use of tabular silver halide grains (to be referred to as "tabular grains" hereinafter) to obtain a high-speed silver halide photographic light-sensitive material is well known to those skilled in the art. Methods of sensitizing these tabular grains by using epitaxial junctions are disclosed in Jpn. Pat. Appln. KOKAI Publication No. (hereinafter referred to as JP-A-)58-108526 and JP-A-59-133540. Also, applications to thinner tabular grains or to tabular grains having larger equivalent-circle diameters are disclosed in JP-A's-8-69069, 8-101472, 8-101474, 8-101475, 8-171162, 8-171163, 8-101473, 8-101476, 9-211762, and 9-211763, and U.S. Pat. Nos. 5,612,176, 5,614,359, 5,629,144, 5,631,126, 5,691,127, and 5,726,007. However, in an epitaxial sensitizing method of using silver chloride as a main composing element, although high sensitivity can be obtained, there is a problem that gradation does not easily become hard. This prevents the epitaxial sensitizing method and the epitaxial grains or prior arts from using it multipurposly in a light-sensitive material for general photographing.

BRIEF SUMMARY OF THE INVENTION

An object of the present invention is to provide a silver halide photographic emulsion satisfying a high sensitivity and a hard gradation of epitaxial tabular grains simultaneously, and a silver halide photographic lightsensitive material using the same.

The inventors of the present invention considered the problem that the gradation is not hard as being caused by the facts that epitaxial protrusion portions of a conventional epitaxial emulsion have a low silver iodide content, and that the halogen compositions of the epitaxial protrusion portions become non-uniform between the epitaxial protrusion portions when one tries to increase the silver iodide content of the epitaxial protrusion portions. Then, the inventors made researches to improve them. As a result, the inventors found that it is possible to increase the silver iodide content of the epitaxial protrusion portions by adding a silver iodide ultrafine grain emulsion prepared just before the addition thereof at the time of forming the epitaxial protrusion portions, and thereby the halogen compositions of the epitaxial protrusion portions become uniform in each grain and between the grains. As a result, the inventors found that it is possible to obtain a photographic property of a high sensitivity and a hard gradation, and completed the present invention.

Namely, the above object has been achieved by the following means (1)–(10).

(1) A silver halide photographic emulsion, wherein at least 70% of the total projected area of silver halide grains contained therein is occupied by silver bromochloroiodide hexagonal epitaxial tabular grains each having (111) faces as main planes and an epitaxial protrusion portion, wherein the epitaxial protrusion portion exists on at least one apex portion of the hexagon, and, when an average silver chloride content of the epitaxial protrusion portions of all the grains having the epitaxial protrusion portion is expressed as CL mol %, a silver chloride content of each epitaxial protrusion portion of each grain falls within the range of 0.7 CL to 1.3 CL.

(2) The silver halide photographic emulsion according to item (1), wherein the silver chloride content of each epitaxial protrusion portion of each grain falls within the range of 0.8 CL to 1.2 CL.

(3) A silver halide photographic emulsion, wherein at least 70% of the total projected area of silver halide grains contained therein is occupied by silver bromochloroiodide hexagonal epitaxial tabular grains each having (111) faces as main planes and an epitaxial protrusion portion, wherein the epitaxial protrusion portion exists on at least one apex portion of the hexagon, and, when an average silver iodide content of the epitaxial protrusion portions of all the grains having the epitaxial protrusion portion is expressed as I mol %, a silver iodide content of each epitaxial protrusion portion of each grain falls within the range of 0.7I to 1.3I.

(4) The silver halide photographic emulsion according to item (3), wherein the silver iodide content of each epitaxial protrusion portion of each grain falls within the range of 0.8I to 1.2I.

(5) The silver halide photographic emulsion according to any one of items (1) to (4), wherein each epitaxial protrusion portion of each grain contains silver iodide, and the silver iodide content of each epitaxial protrusion portion of each grain is at least 10 mol %.

(6) The silver halide photographic emulsion according to item (5), wherein a silver iodide content of each epitaxial protrusion portion of each grain is at least 20 mol %.

(7) A silver halide photographic lightsensitive material, comprising a lightsensitive layer on a support, the lightsensitive layer containing the silver halide photographic emulsion according to any one of above items (1) to (6).

(8) A method of preparing the silver halide photographic emulsion according to any one of above items (1) to (6), wherein the epitaxial protrusion portion are formed by adding a silver iodide ultrafine grain emulsion prepared just before being added.

(9) The method of manufacturing the silver halide photographic emulsion according to above item (8), wherein the average equivalent circle diameter of the silver iodide ultrafine grain emulsion is 0.02 $\mu$m or less.

(10) The method of manufacturing the silver halide photographic emulsion according to above item (8), wherein the average equivalent circle diameter of the silver iodide ultrafine grain emulsion is 0.01 $\mu$m or less.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
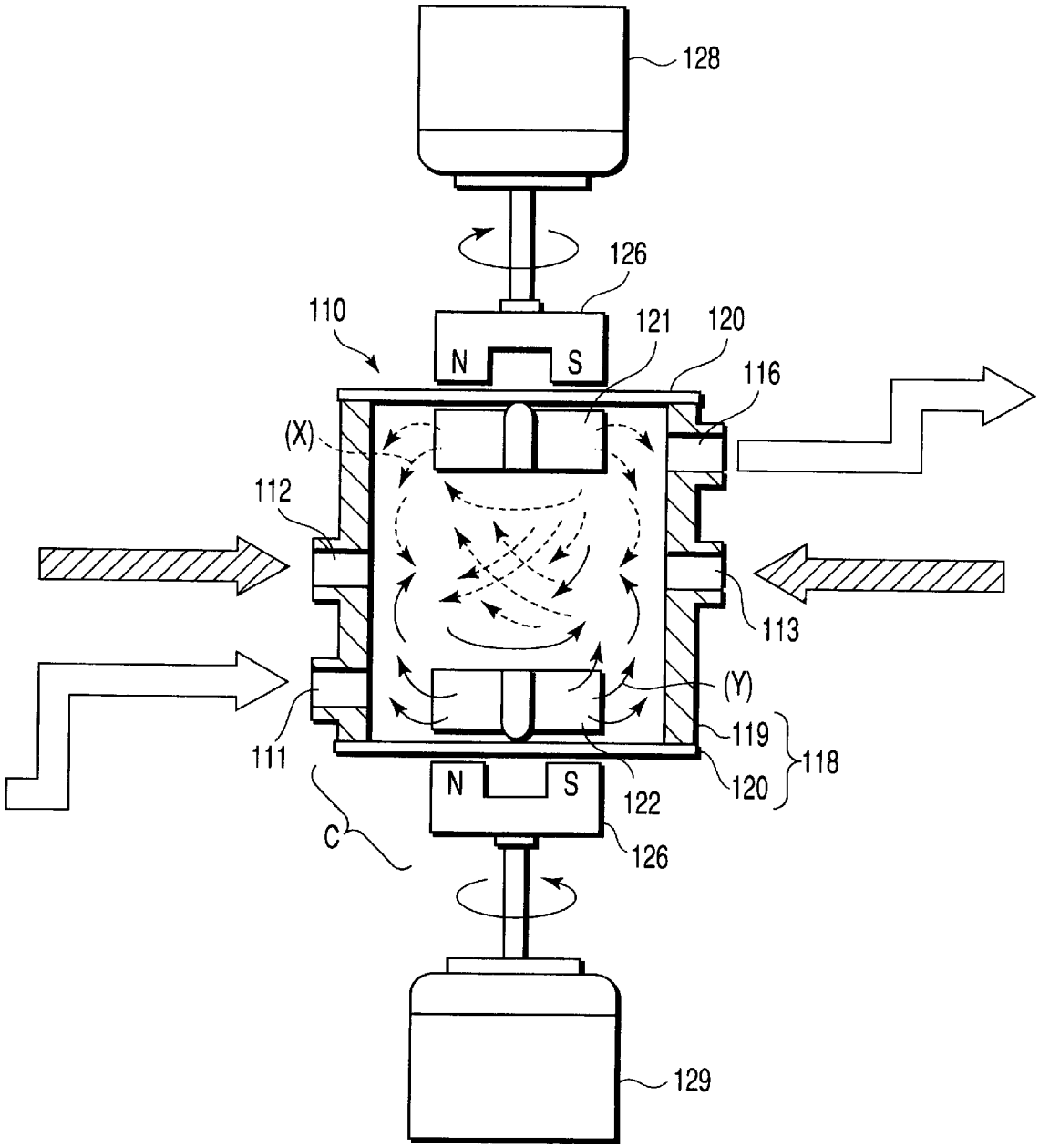
FIG. 1 is a cross sectional view showing a schematic structure of a stirring apparatus used in an embodiment of the present invention.

The silver halide photographic emulsion of the present invention will be explained in detail below.

The silver halide photographic emulsion of the present invention is occupied by silver iodochlorbromide hexagonal epitaxial tabular grains having (111) planes as main planes and having an epitaxial protrusion portion, in an amount of 70% or more of the total projected area of the silver halide grains contained therein.

In epitaxial tabular grains contained in the emulsion of the present invention, a tabular grain to which an epitaxial protrusion portion is deposited is a silver halide grain having two opposing parallel (111) main planes. A tabular grain used in the present invention has one twin plane or two or more parallel twin planes. The twin plane is a (111) plane on the two sides of which ions at all lattice points have a mirror image relationship.

In the emulsion of the present invention, 70% or more of the projected area of all grains preferably are tabular grains to which an epitaxial protrusion is deposited, and have hexagonal main planes in which the ratio of the length of an edge having a maximum length to the length of an edge having a minimum length is 2 to 1. More preferably, 90% or more of the projected area of all grains preferably are tabular grains to which an epitaxial protrusion is deposited, and have hexagonal main planes in which the ratio of the length of an edge having a maximum length to the length of an edge having a minimum length is 2 to 1. Much more preferably 90% or more of the projected area of all grains preferably are tabular grains to which an epitaxial protrusion is deposited, and have hexagonal main planes in which the ratio of the length of an edge having a maximum length to the length of an edge having a minimum length is 1.5 to 1.

The emulsion of the present invention is preferably monodispersed. A variation coefficient of equivalent-circle diameters of projected areas of all grains used in the present invention is preferably 30% or less, more preferably 25% or less, and especially preferably 20% or less. Herein, the variation coefficient of equivalent-circle diameters is the value obtained by dividing the standard deviation of the distribution of the equivalent-circle diameters of individual silver halide grains by their average equivalent-circle diameter.

The equivalent-circle diameters of epitaxial tabular grains are obtained by taking a transmission electron micrograph by using, e.g., the replica method, and calculating the diameter (equivalent-circle diameter) of a circle having an area equal to the projected area of each grain. The thickness of a grain cannot be simply calculated from the shadow of a replica owing to epitaxial deposition. However, the thickness can be calculated by measuring the length of the shadow of a replica before epitaxial deposition. Alternatively, even after epitaxial deposition the thickness can be readily obtained by cutting a sample coated with tabular grains and taking an electron micrograph of the section of the sample. In the emulsion of the present invention, although the equivalent-circle diameter and the thickness are not particularly limited, it is preferable that 70% or more of the total projected area are those having an aspect ration of 7 or more, more preferably, 10 or more. The thickness is preferably 0.12 $\mu$m or less, more preferably 0.1 $\mu$m or less and 0.04 or more.

The epitaxial tabular grains used in the present invention are silver iodochlorobromide. The combination of the host tabular grains being silver iodobromide or silver iodochlorobromide, and the epitaxial protrusion portion being silver iodochlorobromide is preferable. The silver chloride content is of the epitaxial tabular grains of the invention is preferably 0.5 to 6 mol %. The silver iodide content of the epitaxial tabular grains of the invention is preferably 0.5 to 10 mol %, and more preferably the silver iodide content is 1 mol % to 6 mol %.

In the present invention, letting CL mol % be the average silver chloride content of the epitaxial protrusion portions, 70% or more of the total projected area are grains in which the silver chloride content is within the range of 0.7 CL to 1.3 CL, and particularly preferably, 0.8 CL to 1.2 CL. Further, in the emulsion of the present invention, letting I mol % be the average silver iodide content of the epitaxial protrusion portions, 70% or more of the total projected area are grains in which the silver iodide content is within the range of 0.7 I to 1.3 I, and particularly preferably, 0.8 i to 1.2 I. Herein, the average silver chloride content and the average silver iodide content of the epitaxial protrusion portions are mean values of silver chloride contents and silver iodide contents of the epitaxial protrusion portion(s) in each grain and between grains. The intragranular and intergranular Cl and I distributions of the epitaxial protrusion portions can be analyzed by the following method. The tabular grains in the silver halide photographic lightsensitive material are taken out by processing the lightsensitive material with a protein-decomposing enzyme and centrifugal-separating the grains. The grains are redispersed and mounted on a copper mesh coated with a support film. In order to prevent change in quality of the grains, the amount of the protein-decomposing enzyme used is preferably as small as possible. According to circumstances, there may be used a method of cutting the lightsensitive material in layers by using a microtome and taking out the grains together with binders. The grains taken out as described above are viewed from a point perpendicular to the main planes, and a beam whose spot diameter is narrowed to 2 nm or less is scanned by an analytical electron microscope on epitaxial part regions projecting outside from an imaginary hexagon made by extending the sides of the hexagons of the grains, to measure the silver chloride content and the silver iodide content of an epitaxial part region. In order to obtain the intragranular and intergranular distributions, generally 50 epitaxial part regions, preferably 100 or more regions, are measured. The silver chloride content and the silver iodide content of the epitaxial protrusion portions can be calculated by obtaining in advance a ratio of the Ag intensity to the halogen intensity as a calibration line by processing silver halide grains whose contents are known in the same manner.

As an electron gun of the analytical electron microscope, a field-emission type electron gun having an electron density greater than that of a thermionic-type electron gun is more suitable, and it is possible to easily analyze the silver chloride content and the silver iodide content of the epitaxial part. In this step, the measurement is preferably performed with the sample cooled to a low temperature to prevent damage to the sample due to the electron beam. When the silver chloride and/or silver iodide contents are determined with two or more epitaxial protrusion portions per grain, whether the grain is of the present invention or not, is judged on the basis of whether the contents of all the measured points of the grain fall within the prescribed range or not.

In the emulsion of the present invention, 70% or more of the total projected area are occupied by epitaxial tabular grains each having an epitaxial protrusion portion on at least one apex portion of the hexagon. More preferably, 90% or more of the total projected area are occupied by tabular grains each having an epitaxial protrusion portion on at least one apex portion hexagon. The apex portion herein means a portion in a circle which is defined by an apex and two edges forming this apex and which has a radius ⅓ the length of a shorter one of these two edges, when a tabular grain is viewed in a direction perpendicular to its main planes. If the hexagonal tabular grain has hexagonal shape whose apex is rounded, an imaginary hexagon made by extending each edge can be used to determine whether the grain meets the requirement. An emulsion containing grains each having at least one epitaxial protrusion portion at this apex portion is the epitaxial emulsion of the invention. The epitaxial protrusion portions are preferable present at each of the six apex portions, to make the total of six. Usually, epitaxial protrusion portions are formed on the main planes or on edges except for the apex portions of a tabular grain, as well as on the apex portions of a tabular grain. The epitaxial emulsion of the present invention can be discriminated as follows. 100 or more grains are extracted at random from an electron micrograph of replicas of tabular grains and classified into three types of grains: (i) a grain having an epitaxial protrusion portion at one or more apex portions; (ii) a grain having an epitaxial protrusion portion only on edges or on main planes, except for the apex portion; and (iii) a grain having no epitaxial protrusion portion. An emulsion in which 70% or more of the projected area are the grains of (i), i.e., grains each having an epitaxial protrusion portion at one or more apex portions, is the epitaxial emulsion of the present invention. More preferably, 90% or more of the total projected area are grains of (i), are the preferable epitaxial emulsion of the present invention.

The epitaxial protrusion portion is silver iodochlorobromide. Preferably, the silver chloride content of the epitaxial protrusion portion is 5 mol % to 35 mol %. More preferably, the silver chloride content of the epitaxial protrusion portion is 10 mol % to 25 mol %. The silver iodide content of the epitaxial protrusion portion is preferably 1 mol % to 40 mol %. The higher the silver iodide content in the epitaxial protrusion portion, the more remarkable the advantages of the present invention. Accordingly, the iodide content is more preferably, 10 mol % or more, and especially preferably 20 mol % or more.

The silver amount of the epitaxial protrusion portions is preferably 0.5 mol % to 10 mol % of the silver amount of the host tabular grains, more preferably 1 mol % to 5 mol %.

Particular process for preparing the above epitaxial tabular grains of the present invention will be described in detail below in two parts, the one for the preparation of host tabular grains and the other for the preparation of epitaxial portions.

First, the host tabular grains required for the preparation of the epitaxial emulsion of the invention will be described. With respect to the intragranular distribution of silver iodide in the host tabular grains of the present invention, grains of double or more multiple structures are preferred. Herein, the expression "having structures with respect to the distribution of silver iodide" means that there is a difference in silver iodide content of 0.5 mol % or more, preferably 1 mol % or more, between structures.

Structures with respect to the distribution of silver iodide can fundamentally be determined by calculation from formulation values for the step of grain preparation. The change of silver iodide content at each interface of structures can be sharp or gentle. In the ascertainment thereof, although an analytical measuring precision must be considered, the aforementioned analytical electron microscope is effective. This method enables analyzing the intragranular silver iodide distribution as viewed from a position perpendicular to the main plane of tabular grains. Further, by using a specimen obtained by hardening the grain specimen and slicing the hardened specimen with the use of a microtome into extremely thin sections, the method also enables analyzing the intragranular silver iodide distribution across the tabular grain section.

In the host tabular grains, it is preferred that the outermost-shell silver iodide content be higher than inner-shell silver iodide contents. The ratio of the outermost shell is preferably in the range of 1 to 40 mol % based on the total silver quantity. The average silver iodide content thereof is in the range of 1 to 30 mol %. Herein, the ratio of the outermost shell refers to the ratio of the amount of silver used in the preparation of the outermost shell to the amount of silver used for obtaining final grains. The average silver iodide content refers to the molar ratio % of the amount of silver iodide used in the preparation of the outermost shell to the amount of silver used in the preparation of the outermost shell. The distribution thereof may be uniform or nonuniform. More preferably, the ratio of outermost shell is in the range of 5 to 20 mol % based on the total silver quantity, and the average silver iodide content thereof is in the range of 5 to 20 mol %.

The preparation of host tabular grains fundamentally consists of a combination of three steps, namely, nucleation, ripening and growth.

In the step of nucleation of grains for use in the present invention, it is extremely advantageous to employ a gelatin of low methionine content as described in U.S. Pat. Nos. 4,713,320 and 4,942,120; to carry out nucleation at high pBr as described in U.S. Pat. No. 4,914,014; and to carry out nucleation within a short period of time as described in JP-A-2-222940. In the present invention, most preferably, an aqueous solution of silver nitrate, an aqueous solution of halide and an oxidation-processed gelatin of low molecular weight are added within one minute at 20 to 40° C. under agitation in the presence of oxidation-processed gelatin of low molecular weight. At that time, the pBr and pH values of the system are preferably 2 or higher and 7 or below, respectively. The concentration of the aqueous solution of silver nitrate is preferably 0.6 mol/L or less.

In the step of ripening it is possible to effect ripening in the presence of low-concentration base as described in U.S. Pat. No. 5,254,453, and to carry out ripening at high pH as described in U.S. Pat. No. 5,013,641. It is also practical to add, at the step of ripening or subsequent growth, polyalkylene oxide compounds as described in U.S. Pat. Nos. 5,147,771, 5,147,772, 5,147,773, 5,171,659, 5,210,013 and 5,252,453. In the present invention, the ripening step is preferably performed at 60 to 80° C. Immediately after the nucleation or during the ripening, the pBr is preferably lowered to 2 or below. Additional gelatin is preferably added from immediately after the nucleation to the end of ripening. Most preferred gelatin is one having 95% or more of its amino groups modified into succinate or trimellitate.

In the growth step of the present invention, preferably used are simultaneous addition of a silver nitrate aqueous solution, a halogen aqueous solution containing bromide and a silver iodide fine grain emulsion. The silver halide composition of the silver iodide fine grain emulsion may be satisfactory if it is substantially made of a silver iodide, and may contain silver bromide and/or silver chloride as long as they form mixed crystals. Especially preferably the growth step is performed by adding a silver iodebromide fine grain emulsion prepared just before being added. In this step, a halogen aqueous solution, in particular, a bromide aqueous solution is preferably added simultaneously to make the pAg constant.

The epitaxial junction necessary for preparation of the epitaxial emulsion of the present invention will now be detailed. Epitaxial deposition may be performed immediately after formation of the host tabular grains, or may be performed after conventional desalting following formation of the host tabular grains. In the epitaxial emulsion of the present invention, epitaxial deposition is preferably performed immediately after formation of the host tabular grains.

The pH, pAg, and the kind, the concentration and the viscosity of the gelatin are selected for epitaxial formation to be performed immediately after formation of the host tabular grains. The gelatin concentration is important, and a preferable concentration is 50 g or less per liter, and an especially preferable concentration is 5 g to 40 g per liter. If the concentration is too low, epitaxial deposition is caused on the main planes of tabular grains. Further, if the concentration is too high, epitaxial deposition becomes non-uniform between grains since the viscosity increases.

A sensitizing dye is used as a site-indicating agent for the epitaxial junction of the invention. The position of epitaxial deposition can be controlled by selecting the amount and type of employed sensitizing dye. Dyes are each preferably added in an amount of 50 to 90% based on a saturated coating quantity. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes. Any of nuclei commonly used in cyanine dyes as basic heterocyclic nuclei can be employed in these dyes. That is, there can be employed, for example, a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzoindolenine nucleus, an indole nucleus, a benzoxazole nucleus, a naphthoxazole nucleus, a benzothiazole nucleus, a naphthothiazole nucleus, a benzoselenazole nucleus, a benzoimidazole nucleus and a quinoline nucleus. These nuclei may have substituents on carbon atoms thereof.

These sensitizing dyes may be used either individually or in combination. The sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, GB Nos. 1,344,281 and 1,507,803, JP-B's-43-4936 and 53-12375, and JP-A's-52-110618 and 52-109925.

The emulsion of the present invention may be loaded with a dye which itself exerts no spectral sensitizing effect or a substance which absorbs substantially none of visible light and exhibits supersensitization, simultaneously with or separately from the above sensitizing dye.

Increased silver iodide content in the surface composition of host tabular grains at the time of adsorption of sensitizing dye is preferred from the viewpoint of preparation of epitaxial tabular grains. Thus, addition of iodide ions is effected prior to the incorporation of sensitizing dye. The addition amount of such iodide ions or silver iodide is preferably in the range of $1\times10^{-4}$ to $1\times10^{-2}$ mol, more preferably $1\times10^{-3}$ to $5\times10^{-3}$ mol, per mol of host tabular grains.

The epitaxial protrusion portions may be formed by simultaneously adding, or separately adding, a solution containing halogen ions and a solution containing $AgNO_3$. The most preferable method in the present invention is to add a silver nitrate solution and an aqueous solution containing bromide salt and chloride salt and further containing iodide salt, if necessary, by a double jet method, and add a silver iodide ultrafine grain emulsion, which was prepared just before being added, immediately before or simultaneously with the addition of the above solutions. By this method, it is possible to freely control the silver chloride content and the silver iodide content of the epitaxial protrusions, and the distributions of the silver chloride content and the silver iodide content of the epitaxial protrusion portions becomes uniform in each grain and between the grains.

As the silver iodide ultrafine grain emulsion, the emulsion described in U.S. Pat. No. 5,004,679, the disclosure of which is incorporated herein by reference, which is prepared just before being added, is preferably used. Herein, "prepared just before being added" means that the time from its preparation to addition is 10 minutes or less, and preferably 1 minute or less. The silver iodide ultrafine grain emulsion can be easily formed by the method described in U.S. Pat. No. 4,672,026, the disclosure of which is incorporated herein by reference. It is preferable to use a double jet adding method to add a silver salt aqueous solution and an iodide salt aqueous solution, wherein grains are formed with the pI value made constant during the grain formation. Herein the symbol "pI" indicates a logarithm of a reciprocal of the $I^-$ ion concentration of the mixture. Although there are no specific limitations to the temperature, pI, pH, the kind and the concentration of the protective colloidal agent such as gelatin, and the presence/absence, the kind and the concentration of the silver halide solvent, the grain size is preferably 0.02 $\mu$m or less, more preferably 0.01 $\mu$m or less. Although the grain form cannot be completely specified since the grains are fine grains, the coefficient of variation of the distribution of their equivalent circle diameters is preferably 25% or less. If the coefficient is 20% or less, it is possible to remarkably obtain the advantage of the present invention.

The size and the size distribution of the silver iodide ultrafine grain emulsion are obtained by mounting the silver iodide ultrafine grains on a mesh for electron microscope observation and observing them directly by a transmission method, not a carbon replication method. This is because the equivalent circle diameters of the grains are small and thus the measurement error is too large in observation by a carbon replication method. Further, since the equivalent circle diameters are small and unstable, it is basically necessary to adopt means such as addition of a ripening-inhibiting agent and freezing. Silver iodide ultrafine grains most effective in the present invention have an average equivalent circle diameter of 0.005 μm to 0.01 μm, and a coefficient of variation of the distribution of the equivalent circle diameters is 18% or less.

A most preferable method used to add the above silver iodide ultrafine grain emulsion prepared just before being added is the method using a mixer, which is described in JP-A-10-43570, the disclosure of which is incorporated herein by reference.

A mixer is a stirring apparatus comprising: an stirring vessel having a predetermined number of supply ports for flowing water-soluble silver salt and water-soluble halogen salt to be stirred into the vessel, and a discharging port for discharging a silver halide fine grain emulsion generated after stirring processing; and stirring means for controlling the stirring state of the liquid in the stirring vessel by stirring blades being rotation-driven in the stirring vessel. Preferably, the stirring means performs stirring and mixing by at least two stirring blades rotation-driven in the stirring vessel, and the at least two stirring blades are arranged in positions in the stirring vessel with a distance so as to be opposed to each other, and rotation-driven in converse directions each other. Preferably each of the stirring blades is coupled by magnetism to an outside magnet disposed outside the adjacent vessel wall, thereby to form a structure having no shaft piercing through the vessel walls. The stirring blades are rotated by rotation-driving their respective outside magnets by motors disposed outside the vessel. As one of the outside magnets coupled to the stirring blades by magnetic coupling, used is a double sided bipolar magnet comprising an N pole face and an S pole face disposed so as to be parallel to a central axis line of rotation and superposed interposing the central axis of rotation. Further, as the other outside magnet, used is a bilateral bipolar magnet comprising an N pole face and an S pole face standing abreast at symmetrical positions to the central axis of rotation on the plane orthogonal to the central axis line of rotation.

FIG. 1 shows an embodiment of a mixer (stirring apparatus) relating to the present invention.

A mixing vessel 118 comprises a vessel main body 119 with a central axis directed in the vertical direction, and seal plates 120 serving as vessel walls for sealing top and bottom opening ends of the vessel main body 119. Stirring blades 121 and 122 are arranged apart from each other at opposing top and bottom ends in the stirring vessel 118, and rotation-driven in opposite directions. The stirring blades 121 and 122 form magnetic coupling with respective outside magnets 126 arranged outside the vessel walls adjacent to the stirring blades 121 and 122. Specifically, the stirring blades 121 and 122 are coupled to the respective outside magnets 126 by magnetic force, and rotation-driven in converse directions by rotation-driving the outside magnets 126 by independent motors 128 and 129.

The stirring vessel 118 comprises liquid supply ports 111, 112 and 113 for introducing a silver salt aqueous solution, a halogen salt aqueous solution, and if necessary a colloidal solution to be stirred, and a discharge port 116 for discharging a stirred silver halide fine grain emulsion. The silver salt aqueous solution and the halogen salt aqueous solution are preferably added toward the stirring blades, and the angle between the liquid supply ports 111 and 112 is preferably as large as possible. Specifically, 90° is more preferable than 60°, and 180° is further preferable.

A method of preparing the silver iodide ultrafine grain emulsion to be prepared just before being added will now be described. Specifically, the following features are described in detail: (a) number of revolution of stirring; (b) residence time; (c) addition method and the kind of protective colloid; (d) temperature of the added liquids; (e) concentration of the added liquid; and (f) electric potential.

(a) Number of Revolution of Stirring

When the opposing stirring blades in the mixer are driven, their number of revolution is preferably 1000 rpm to 15000 rpm, more preferably 3000 rpm to 15000 rpm, and most preferably 4000 rpm to 12000 rpm. A number of revolution exceeding 15000 rpm is not preferable since it makes the centrifugal forces of the stirring blades too strong, which causes a backward flow toward the addition ports. Further, the stirring blades rotated in converse directions may be rotated at the same number of revolution, or rotated at different numbers of revolution.

(b) Residence Time

The residence time t of the added liquids to be introduced into the mixer is represented by the following formula:

$$t=60V/(a+b+c)$$

t: residence time (second)

V: volume of the mixing space of the mixer (mL)

a: addition current of silver salt solution (mL/minute)

b: addition current of halide salt solution (mL/minute)

c: addition current of protective colloidal solution (mL/minute)

The residence time t is preferably 0.1 to 5 seconds, more preferably 0.1 to 1 second, and most preferably 0.1 to 0.5 seconds. When residence time t exceeds 5 seconds, silver halide fine grains once generated in the mixer grow to a larger size, and its size distribution becomes wider, which is not preferable. Further, the residence time less than 0.1 second is not preferable, since the added liquids remaining unreacted are discharged from the mixer.

(c) Addition Method and the Kind of Protective Colloid

When a protective colloidal aqueous solution is added to the mixer, the following addition methods are used.

a. A protective colloidal solution is singly injected into the mixer. The concentration of the protective colloid is at least 0.5 wt. %, preferably 1 to 20 wt. %. The flow rate of the colloidal solution is preferably at least 20–300% of the sum of the flow amounts of the silver salt solution and the halide solution, more preferably 50–200%.

b. A protective colloid is made contained in the halide salt solution. The concentration of the protective colloid is at least 0.4 wt. %, preferably 1 to 20 wt. %.

c. A protective colloid is made contained in the silver salt solution. The concentration of the protective colloid is at least 0.4 wt. %, preferably 1 to 20 wt. %. If gelatin is used, the silver salt solution and gelatin solution had better be added just before use, since silver ions and gelatin form silver ion complex with gelatin which is photolyzed and pyrolyzed to generate colloidal silver.

The above methods a–c may be used individually, or two or three of them may be used simultaneously in combination with each other.

Further, in the mixer used in the present invention, gelatin is generally used as the protective colloid. Alkaline processing is generally used to process the gelatin. In particular, it is preferable to use alkaline-processed gelatin which has been subjected to deionization and/or ultrafiltration to remove impurity ions and impurities. Besides alkaline-processed gelatin, it is possible to use: gelatin derivatives such as acid-processed gelatin, phthalated gelatin, trimellitated gelatin, succinated gelatin, maleated gelatin and esterified gelatin; low molecular-weight gelatin (having a molecular weight of 1000 to 80000, and containing gelatin decomposed by an enzyme, gelatin hydrolyzed with acid and/or alkali, and pyrolyzed gelatin); high molecular-weight gelatin (having a molecular weight of 110000 to 300000); gelatin having a methionine content of 40 $\mu$mol/g or less; gelatin having a tyrosine content of 20 $\mu$mol/g or less; oxidized gelatin; and gelatin wherein methionine is inactivated by alkylation. A mixture of two or more kinds of gelatins may be used.

In order to form finer silver halide fine grains by using the mixer, it is necessary to keep the temperatures of the solutions to be added to the mixer as low as possible. However, since gelatin is readily solidified under a temperature not exceeding 35° C., it is preferable to use a low molecular-weight gelatin which is not solidified even under a low temperature. The molecular weight of a low molecular-weight gelatin is preferably 50000 or less, preferably 30000 or less, and more preferably 10000 or less. Further, a synthetic polymer which is a synthetic colloid having a protective colloidal function for the silver halide grains can be used in the present invention, since it also is not solidified under a low temperature. Furthermore, natural polymers other than gelatin can be used in the present invention in the same manner. These are described in Japanese Patent Publication KOKOKU No. (hereinafter referred to as "JP-B-") 7-111550, and "Research Disclosure" Vol. 176, No. 17643 (December, 1978), Section IX, the disclosure of which is incorporated herein by reference.

(d) Temperature of the Added Liquids

The temperatures of the liquids to be added are preferably 10–60° C. However, in view of downsizing and suitability of preparation, the temperatures are more preferably 20–40° C., and most preferably 20–30° C. Further, in order to prevent generation of heat of reaction in the mixer and ripening of the formed silver iodide fine grains, the temperatures of the mixer and the piping are preferably controlled.

(e) Concentration of Added Liquid

In a mixer provided outside the reaction vessel, since generally no dilution by a bulk liquid is performed, using thick addition liquids increases the size of silver iodide fine grains to be formed, and tends to deteriorate the size distribution. However, since the above mixer is superior to conventional stirring apparatuses in stirring and mixing, it has succeeded in forming silver iodide ultrafine grains of a small size and a narrow size distribution even if it uses thick addition liquids. Specifically, the concentrations of the addition liquids are preferably 0.05 mol/liter (hereinafter also denoted as "L") to 1.2 mol/L, more preferably 0.05 to 0.8 mol/L.

(f) Electric Potential

With respect to the electric potential (halogen excess amount) for forming cubic system silver iodide ultrafine grains, from the viewpoint of downsizing, it is preferable to form the grains at a potential set to a pAg range to have a small solubility. Specifically, pAg is preferably 8.5 to 11.5, more preferably 9.5 to 10.5.

As the result of repeating researches with respect to the above points (a)–(f), the inventors succeeded in preparing cubic system silver iodide ultrafine grains having an average equivalent sphere diameter of 0.008 to 0.02 $\mu$m.

The silver iodide ultrafine grains prepared as described above are immediately supplied to the reaction vessel. The word "immediately" indicates "within 10 minutes", preferably "within 1 minute". Since the equivalent circle diameters of the silver iodide ultrafine grains become larger with the lapse of time, a shorter time is more preferable.

In order to add to the reaction vessel the silver iodide ultrafine grains formed in the mixing vessel outside the reaction vessel, as described above, the grains may be added continuously, or may be added after once being stored in the mixing vessel. Further, these methods may be used together. However, if the grains are temporally stored in the mixing vessel, the temperature is preferably 40° C. or less, and more preferably 20° C. or less. Further, the storing time is preferably as short as possible.

After, or simultaneously with, addition of the silver iodide ultrafine grain emulsion prepared just before being added, an $AgNO_3$ solution is added to the reaction vessel. When an $AgNO_3$ solution is added, the addition time is preferably 30 seconds to 10 minutes, especially preferably 1 to 5 minutes. In order to form the epitaxial emulsion of the present invention, the concentration of the silver nitrate solution to be added is preferably 1.5 mol/L or less, especially preferably 0.5 mol/L. At this time, stirring in the system need to be performed efficiently, and the viscosity in the system is preferably low.

The silver amount of the epitaxial protrusion portions is preferably 0.5 to 10 mol % of the silver amount of the host tabular grains, more preferably 1 to 5 mol %. If the silver amount is too small, the epitaxial emulsion cannot be prepared. If it is too large, the epitaxial emulsion becomes unstable.

The pBr during formation of the epitaxial parts is preferably at least 2.5, especially preferably at least 3.0. The formation of the epitaxial parts is preferably performed at a temperature of 35 to 45° C. A hexacyano metal complex is preferably doped to the epitaxial protrusion portions in the formation of the epitaxial protrusion portions.

Among hexacyano metal complexes, preferable complexes contain iron, ruthenium, osmium, cobalt, rhodium, iridium or chromium. The addition amount of the metal complex preferably ranges from $10^{-9}$ to $10^{-2}$ mol per mol of the silver halide of the finished grains, more preferably $10^{-8}$ to $10^{-4}$ mol per mol of the silver halide.

The sensitizing dyes described above and/or an antifoggant and/or a stabilizer described below are preferably added to the emulsion of the present invention after the epitaxial deposition.

It is preferable to wash with water an emulsion of the present invention after this. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

As the protective colloid to be dispersed afterwards, gelatin is advantageous. Most preferably, gelatin of high molecular weight obtained by cross-linking usual gelatin by a conventional chemical process. The use of such gelatin make the epitaxial emulsion of the invention more stable. Also, use can be made of other hydrophilic colloids.

For example, use can be made of a variety of synthetic hydrophilic polymeric materials including proteins such as gelatin derivatives, graft polymers from gelatin/other polymers, albumin and casein; sugar derivatives, for example, cellulose derivatives such as hydroxyethylcellulose, carboxymethylcellulose and cellulose sulfate, sodium alginate and starch derivatives; and homo- or copolymers such as polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole. Suitable gelatins include, for example, not only lime treated gelatins but also acid treated gelatins and, further, enzyme treated gelatins as described in Bull. Soc. Sci. Photo. Japan, No. 16, p.30 (1966). Also, use can be made of gelatin hydrolyzates and enzymolyzates.

For the emulsion of the invention, it is preferable to perform chemical sensitization after washing with water and redipsersion. One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxazolinethione; and azaindenes such as triazaindenes, tetrazaindenes (particularly 4-hydroxy-substituted(1,3,3a,7) tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the equivalent circle diameter of grain, decreasing the solubility of grains, controlling chemical sensitization, and controlling the arrangement of dyes.

The silver halide photographic emulsion is preferably subjected to reduction sensitization during grain formation; after grain formation and before chemical sensitization; during chemical sensitization; or after chemical sensitization.

Herein, the reduction sensitization can be selected from a method of adding a reduction sensitizer to a silver halide emulsion, a method of growing or ripening grains under the atmosphere of a low pAg of from pAg of 1 to 7, which is called a silver ripening, or a method of growing or ripening grains under the atmosphere of a high pH of from pH of 8 to 11, which is called a high pH ripening. Further more, two or more methods can be combined.

An oxidizer capable of oxidizing silver is preferably used during the process of producing the emulsion for use in the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].\ 6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen-releasing compounds (e.g., N-bromosuccinimide, chloramine T and chloramine B).

A silver halide photographic material that the silver halide photographic emulsion of the present invention is applied, is only required to have at least one lightsensitive layer on a support. Preferably, the silver halide photographic material is provided with at least one of blue-sensitive layer, green-sensitive-layer, and red-sensitive layer. The number and the order of the silver halide emulsion layer and a non-lightsensitive layer are not particularly limited. A typical example thereof is a silver halide photographic lightsensitive material having at least one color-sensitive layer unit composed of a plurality of silver halide emulsion layers having substantially the same color sensitivity but different in speeds. The color-sensitive layer unit may be one sensitive to any one of blue light, green light and red light. In a multi-layered silver halide color photographic lightsensitive material, the arrangement of the unit lightsensitive layers is generally a red sensitive layer, green sensitive layer, and blue sensitive layer in this order from the support. However, the order may be reversed depending on purposes. A order of arrangement is also possible in which the same color-sensitive layers sandwich a different color-sensitive light-sensitive layer.

The emulsion of the present invention may be used in each of the blue sensitive, green sensitive and red sensitive layers. The green sensitive and red sensitive layers are preferable, and the green sensitive layer is more preferable.

In the lightsensitive material concerning the invention, various additives mentioned above may be used. Other various additives may also be used depending on the purposes.

The additives are described in detail in Research Disclosure Item 17643 (December 1978), Item 18716 (November 1979) and Item 308119 (December 1989), the disclosures of which are incorporated herein by reference. A summary of the locations where they are described will be listed in the following table.

| | Types of additives | RD17643 | RD18716 | RD308119 |
|---|---|---|---|---|
| 1 | Chemical sensitizers | page 23 | page 648 right column | page 996 |
| 2 | Sensitivity-increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column. |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the light-sensitive material.

Various color couplers may be used in the invention, and specific examples thereof are described in the patents described in the above cited Research Disclosure No. 17643, VII-C to G and No. 307105, VII-C to G.

EXAMPLES

Example-1

Advantages of the distribution of the silver chloride content in the epitaxial protrusion portion and the distribution of the silver iodide content in the epitaxial protrusion portion will be described in detail below.

(Preparation of Emulsion a)

1,600 mL of an aqueous solution containing 1.2 g of KBr and 1.9 g of oxidation-processed gelatin having an average molecular weight of 15,000 was stirred at 30° C. An aqueous $AgNO_3$ (2.7 g) solution and an aqueous halide solution (containing 1.9 g of KBr and 3.0 g of the above gelatin) were added over 12 sec by a double jet method. After an aqueous KBr solution (KBr 3.22 g) was added, the temperature was raised to 49° C. After an aqueous solution containing 22 g of oxidation-processed gelatin having an average molecular weight of 100,000 was added, an aqueous $AgNO_3$ (175.3 g) solution and an aqueous KBr solution were added over 29 min as a first growth. During the addition, the silver potential was held at −20 mV with respect to a saturated calomel electrode. Then, an aqueous $AgNO_3$ (25.8 g) solution, an aqueous KI solution (6 mol % with respect to Ag) and a KBr aqueous solution were added over 17 min by a triple jet method as a second growth. For the initial 9 min of the addition, the silver potential was held at −20 mV with respect to a saturated calomel electrode by adjusting the addition of the KBr solution, and then the silver potential was held at 58 mV. An aqueous solution containing 14 g of phthalated gelatin having an average molecular weight of 100,000 and 14 g of conventional gelatin having an average molecular weight of 100,000 was added. So far, host tabular grains before epitaxial deposition were completed.

The temperature of the mixture was lowered to 30° C., and a KI (0.36 g) solution was added to the solution. Thereafter, sensitizing dyes I, II and III in a mole ratio of 7:2:1 were added to the mixture at a ratio of 85% of the saturated covering amount. Then, $9.9\times10^{-5}$ mol (per mol of the silver amount of the host tabular grains, hereinafter) of potassium hexacyanorutheniumate (II) was added to the mixture. 100 mL of $AgNO_3$ (9.6 g) aqueous solution and 100 mL of halogen aqueous solution containing KBr (3.6 g), NaCl (4.9 g) and KI (2.25 g) were added to the mixture for 1 minutes by a double jet method.

After $1\times10^{-4}$ mol of an antifoggant I was added, the emulsion was washed at 35° C. by a conventional method, and then a deionized gelatin having a 100000 average molecular weight was added and redispersed at 40° C. to adjust the pH of the emulsion to 6.5. The temperature of the emulsion was raised to 50° C., and potassium thiocyanate, chloroauric acid, sodium thiosulfate, and N,N-dimethylselenourea were added to perform optimum chemical sensitization. Then, $5\times10^{-4}$ mol of an antifoggant II was added to the emulsion to terminate chemical sensitization. This emulsion obtained was used as Emulsion a.

Emulsion a was constituted by tabular grains having an average equivalent circle diameter of 0.78 μm, a coefficient of variation of the equivalent circle diameters of 22%, an average thickness of 0.069 μm, a coefficient of variation of the thicknesses of 15%, and an average aspect ratio of 11.3. Further, at least 90% of the total projected area of all the grains was occupied by hexagonal tabular grains, whose ratio of the length of a side having the maximum length to the length of a side having the minimum length is 1.4 or less. As the result of observation of the cross sections of the grains by an electron microscope, an average twin-face interval was 0.008 μm, and its coefficient of variation was 17%. As the result of observation by a transmission electron microscope at a low temperature, grains occupying at least 90% of the total projected area have no dislocation lines in parts other than the epitaxial protrusion portions. In this emulsion, the total silver iodide content of the host tabular grains was 0.76 mol %, and the total silver amount of the epitaxial protrusion portions was 4.71 mol % to the total silver amount of the host tabular grains, and 4.50 mol % to the total silver amount of the grains.

Sensitizing dye I

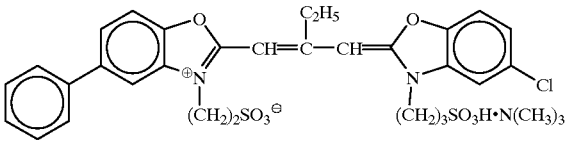

Sensitizing dyey II

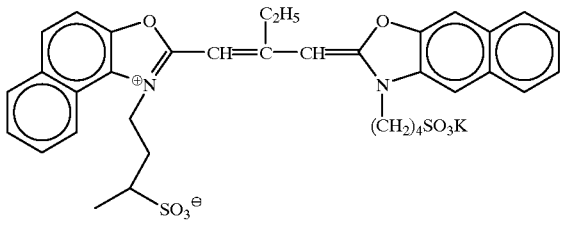

Sensitizing dye III

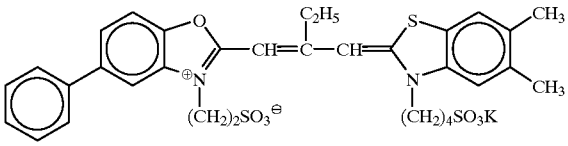

Antifoggant I

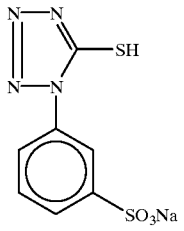

-continued

Antifoggant II

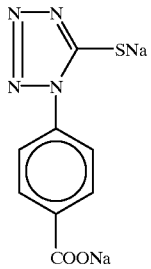

(Preparation of Emulsion b)

Emulsion b was prepared in the same manner as the preparation of Emulsion a, except that the epitaxial formation method was changed as follows. After potassium hexacyanorutheniumate (II) was added, an AgI ultrafine grain emulsion prepared just before being added was added by 2.25 g in terms of KI. The AgI ultrafine grain emulsion was prepared by using the stirring apparatus described in the Description of the present invention, by adding to the stirring apparatus an $AgNO_3$ aqueous solution of 1.92 wt. % and an aqueous solution containing 1.92 wt. % of KI 1.9 wt. % of gelatin having an average molecular weight of 20000 at 25° C. with the equal flow rate. Five seconds after the preparation, of the AgI ultra fine grain emulsion, it was continuously added over 1 minute. The average equivalent circle diameter of the AgI ultrafine grains was 0.0088 μm, and the coefficient of variation of the distribution of the equivalent circuit diameters was 24%. One minute later, 100 mL of an $AgNO_3$ (9.6 g) aqueous solution and 100 mL of a halogen aqueous solution containing KBr (5.2 g) and NaCl (4.9 g) were added over 1 minute by a double jet method.

(Preparation of Emulsion c)

Emulsion c was prepared, by adding a silver iodide fine emulsion prepared in advance, having an average equivalent circle diameter of 0.03 μm and a coefficient of variation of the equivalent circle diameters of 14%, instead of the silver iodide ultrafine grains prepared just before being added, in preparation of Emulsion b. However, a part of the silver iodide fine grain emulsion remained undissolved, and subsequent evaluations of photographic properties or the like could not be performed.

Figure 2:
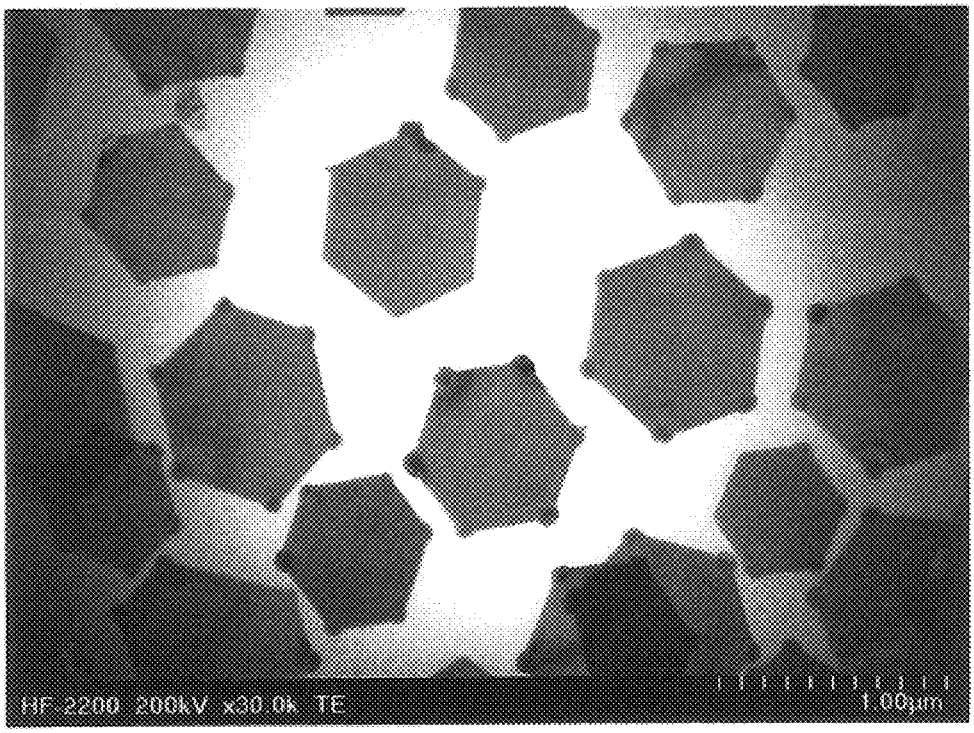
FIG. 2 is a photograph of Emulsion b taken by an analytical electron microscope mounted with a field-emission type electron gun (magnifications: 30,000).

The intramolecular and intermolecular Cl and I distributions of the epitaxial parts were obtained by scanning a beam having a spot diameter of 1 nm on each of 50 epitaxial projection regions projecting outside from the imaginary hexagon made by extending the sides of their hexagons, by an analytical electron microscope mounted with a field-emission type electron gun. FIG. 2 shows a representative measurement photograph of Emulsion b.

Figure 3:
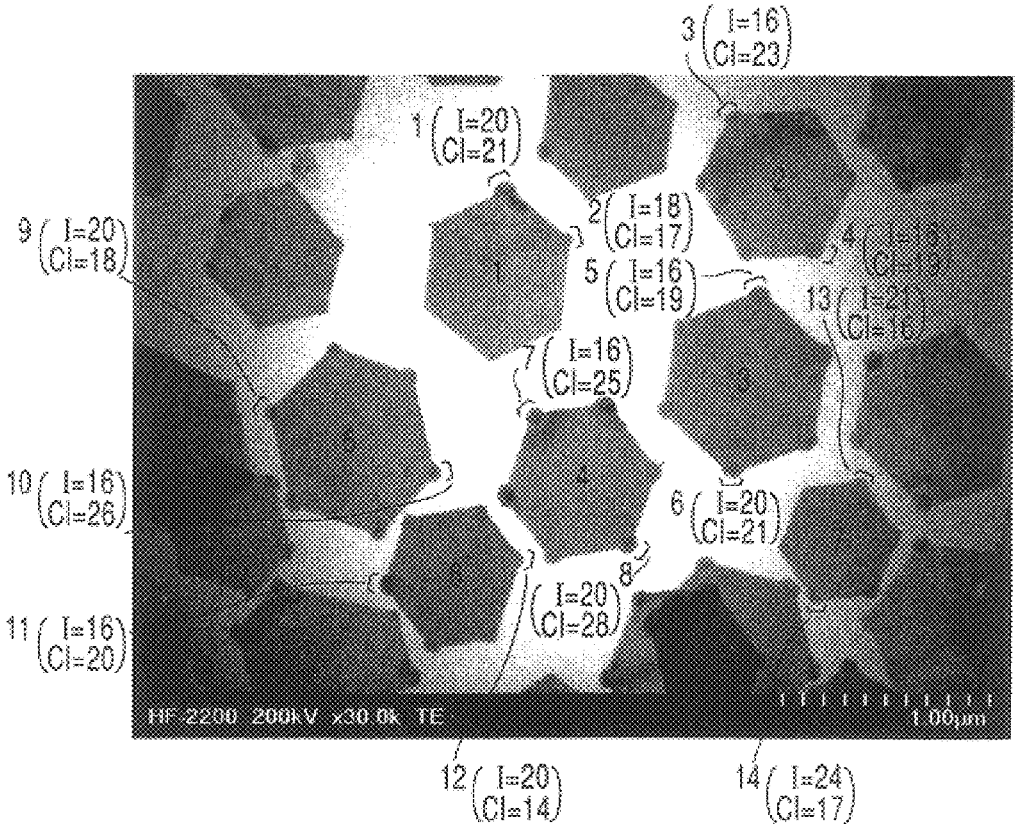
FIG. 3 is a diagram obtained by copying the analytical electron microscope photograph of FIG. 2.

FIG. 3 shows a diagram obtained by copying the analytical electron microscope photograph of FIG. 2. In FIG. 3, the silver iodide content <I(mol %)> and the silver chloride content <Cl(mol %)> of each of the epitaxial protrusion portions (1–14) of the grains denoted by reference numerals 1–7 are shown in parentheses.

Table 1 shows the characteristics of Emulsions a–c together. The presence/absence of the deposition of the epitaxial parts were obtained on the basis of observations by an electron microscope by means of replica method. The characteristics of Emulsions b and c other than those shown in Table 1 were basically almost the same as those of Emulsion a.

TABLE 1

| | Ratio of grains having an epitaxial protrusion portion (%) | Average composition of epitaxial protrusion portion | Ratio of distribution of Cl content in epitaxial protrusion portion (%) | | Ratio of distribution of I content in epitaxial protrusion portion (%) | |
|---|---|---|---|---|---|---|
| | | | 0.7 to 1.3Cl | 0.8 to 1.2Cl | 0.7 to 1.3I | 0.8 to 1.2I |
| Emulsion a (Comp.) | 95 | $Br_{58}I_{18}Cl_{24}$ | 65 | 47 | 53 | 32 |
| Emulsion b (Inv.) | 95 | $Br_{56}I_{19}Cl_{25}$ | 85 | 74 | 98 | 89 |
| Emulsion C (Comp.) | Could not determine because unsolved fine grains were remained. | | | | | |

As is clear from the results shown in Table 1, by adding the silver iodide ultrafine grain emulsion prepared just before being added, the silver chloride content and the silver iodide content of the epitaxial protrusion portions become uniform between epitaxials.

Each of the above chemically sensitized Emulsions a and b was coated on a cellulose triacetate film provided with a substratum under the coating conditions as shown in following Table 2, together with a protective layer to form Sample Nos. 1 and 2.

TABLE 2

| Emulsion coating conditions | |
|---|---|
| (1) Emulsion layer | |
| Emulsion: Each emulsion | (silver $2.1 \times 10^{-2}$ mol/m$^2$) |
| coupler | ($1.5 \times 10^{-3}$ mol/m$^2$) |

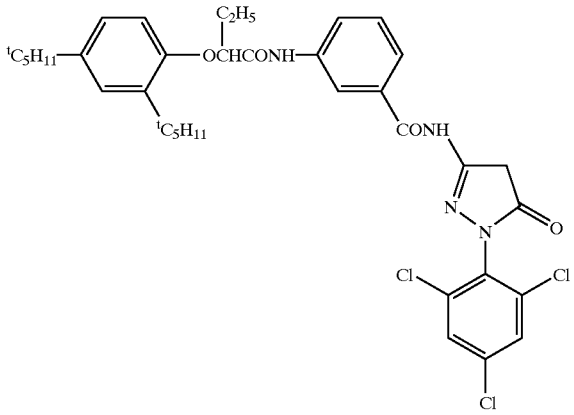

| | |
|---|---|
| | ($1.1 \times 10^{-4}$ mol/m$^2$) |

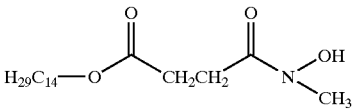

| | |
|---|---|
| Tricresyl phosphate | (1.10 g/m$^2$) |
| Gelatin | (2.30 g/m$^2$) |
| (2) Protective layer | |
| 2,4-dichloro-6-hydroxy-s-triazine sodium salt | (0.08 g/m$^2$)j |
| Gelatin | (1.80 g/m$^2$)j |

These samples were left for 14 hours under the conditions of 40° C. and the relative humidity of 70%. Thereafter, the samples were subjected to an exposure of 1/100 second through a gelatin filter SC-50 manufactured by Fuji Photo Film Co., Ltd. and a continuous wedge.

The samples were subjected to color negative processing by a conventional method by using a negative processor FP-350 manufactured by Fuji Photo Film Co., Ltd.

The densities of the processed samples were measured by a green filter. Further, the same evaluation was performed with respect to the case of changing the color development processing time from 3 minutes and 15 seconds to 1 minute and 15 seconds, to evaluate the development progress property.

Table 3 shows the values of the sensitivities obtained by the above method at each of densities equal to the fog plus 0.2 and 2.0 and the fog values of the samples.

TABLE 3

| | | Development time: 1 min 15 sec | | | Development time: 3 min 15 sec | | |
|---|---|---|---|---|---|---|---|
| | | | Sensitivity | | | Sensitivity | |
| Sample No. | Emulsion | Fog | Fog + 0.2 | Fog + 2.0 | Fog | Fog + 0.2 | Fog + 2.0 |
| 1 | a (Comp.) | 0.10 | 100 | 48 | 0.26 | 123 | 92 |
| 2 | b (Inv.) | 0.09 | 148 | 97 | 0.14 | 165 | 143 |

As is clear from comparison between Emulsions a and b in Table 3, since the silver chloride content and the silver iodide content of the epitaxial protrusion portions are uniform between the epitaxials of Emulsion b, Emulsion b is not only excellent in the sensitivity/fog ratio, but also the gradation is hard. In particular, the advantages are remarkable in the case of the shorter development time, wherein the development progress is very fast.

Example-2

Advantages of the present invention obtained by adding a silver iodide ultrafine grain emulsion prepared just before being added in the case of increasing the silver iodide content of the epitaxial parts will now be further described.

(Preparation of Emulsion d)

In the Emulsion c of Example-1, a part of the silver iodide fine grain emulsion prepared in advance and having an average equivalent circle diameter of 0.03 μm remained undissolved, and thus its photographic characteristics could not be evaluated. Therefore, the preparation of Emulsion c was changed as follows to prepare Emulsion d.

As a second growth of Emulsion c, an $AgNO_3$ (25.8 g) aqueous solution, a KI aqueous solution (6 mol % for Ag) and a KBr aqueous solution were added over 17 minutes by means of a triple jet method. During the addition, addition of the KBr aqueous solution was adjusted so that the silver potential of the mixture was maintained at −20 mV with respect to the saturated calomel electrode for the first 9 minutes, and at 0 mV thereafter. Further, the amount of the prepared silver iodide fine grain emulsion was decreased to 1.1 g in terms of KI. By these changes, the silver iodide fine grain emulsion remaining undissolved was almost disappeared.

(Preparation of Emulsion e)

Emulsion e was prepared by increasing the amount of the AgI ultrafine grain emulsion, prepared just before being added, to 2.8 g in terms of KI in Emulsion b of Example-1.

Table 4 shows the characteristics of Emulsions d and e together. The characteristics of the emulsions other than those described in Table 4 were basically almost the same as those of Emulsion a.

TABLE 4

| | Ratio of grains having an epitaxial protrusion portion (%) | Average composition of epitaxial protrusion portion | Ratio of distribution of Cl content in epitaxial protrusion portion (%) | | Ratio of distribution of I content in epitaxial protrusion portion (%) | |
|---|---|---|---|---|---|---|
| | | | 0.7 to 1.3Cl | 0.8 to 1.2Cl | 0.7 to 1.3I | 0.8 to 1.2I |
| Emulsion d (Comp.) | 65 | $Br_{66}I_{10}Cl_{24}$ | 78 | 64 | 73 | 61 |
| Emulsion e (Inv.) | 95 | $Br_{52}I_{24}Cl_{24}$ | 82 | 70 | 96 | 84 |

As is clear from the results shown in Table 4, using the method of the present invention increases the silver iodide content of the epitaxial protrusion portions, increases the ratio of grains having epitaxial protrusion portions, and enables uniformizing the silver chloride content and the silver iodide content of the epitaxial protrusion portions in each grain and between grains.

Table 5 shows the results of evaluations of photographic characteristics of the emulsions coated in the same manner as in Example-1.

TABLE 5

| | Development time: 1 min 15 sec | | | Development time: 3 min 15 sec | | |
|---|---|---|---|---|---|---|
| | | Sensitivity | | | Sensitivity | |
| Emulsion | Fog | Fog + 0.2 | Fog + 2.0 | Fog | Fog + 0.2 | Fog + 2.0 |
| d (Comp.) | 0.10 | 119 | 61 | 0.18 | 137 | 112 |
| e (Inv.) | 0.09 | 165 | 130 | 0.14 | 173 | 159 |

As is clear from Table 5, the emulsion of the present invention, wherein epitaxial protrusion portions are formed by adding the silver iodide ultrafine grain emulsion prepared just before being added, achieves a low fogging, a high speed and a hard gradation. Thereby, it is possible to uniformly increase the silver iodide content of the epitaxial protrusion portions, to obtain a very fast development. Specifically, the emulsion produces photographic characteristics wherein the gradation is very hard in particular in the case of a short processing time.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion, wherein at least 70% of the total projected area of silver halide grains contained therein is occupied by silver bromochloroiodide hexagonal epitaxial tabular grains each having (111) faces as main planes and an epitaxial protrusion portion, wherein the epitaxial protrusion portion exists on at least one apex portion of the hexagon, and, when an average silver chloride content of the epitaxial protrusion portions of all the grains having the epitaxial protrusion portion is expressed as CL mol %, a silver chloride content of each epitaxial protrusion portion of each grain is 35% or less, and the silver chloride content falls within the range of 0.7 CL to 1.3 CL.

2. The silver halide photographic emulsion according to claim 1, wherein the silver chloride content of each epitaxial protrusion portion of each grain is 35% or less, and the silver chloride content falls within the range of 0.8 CL to 1.2 CL.

3. The silver halide photographic emulsion according to claim 2, wherein each epitaxial protrusion portion of each grain contains silver iodide, and the silver iodide content of each epitaxial protrusion portion of each grain is at least 10 mol %.

4. The silver halide photographic emulsion according to claim 3, wherein a silver iodide content of each epitaxial protrusion portion of each grain is at least 20 mol %.

5. The silver halide photographic emulsion according to claim 1, wherein each epitaxial protrusion portion of each grain contains silver iodide, and the silver iodide content of each epitaxial protrusion portion of each grain is at least 10 mol %.

6. The silver halide photographic emulsion according to claim 5, wherein a silver iodide content of each epitaxial protrusion portion of each grain is at least 20 mol %.

7. A silver halide photographic emulsion, wherein at least 70% of the total projected area of silver halide grains contained therein is occupied by silver bromochloroiodide hexagonal epitaxial tabular grains each having (111) faces as main planes and an epitaxial protrusion portion, wherein the epitaxial protrusion portion exists on at least one apex portion of the hexagon, and, when an average silver iodide content of the epitaxial protrusion portions of all the grains having the epitaxial protrusion portion is expressed as I mol %, a silver iodide content of each epitaxial protrusion portion of each grain falls within the range of 0.71 to 1.31, and a silver chloride content of each epitaxial protrusion portion of each grain is 35 mol % or less.

8. The silver halide photographic emulsion according to claim 7, wherein the silver iodide content of each epitaxial protrusion portion of each grain falls within the range of 0.8I to 1.2, I and a silver chloride content of each epitaxial protrusion portion of each grain is 35 mol % or less.

9. The silver halide photographic emulsion according to claim 8, wherein each epitaxial protrusion portion of each grain contains silver iodide, and the silver iodide content of each epitaxial protrusion portion of each grain is at least 10 mol %.

10. The silver halide photographic emulsion according to claim 9, wherein a silver iodide content of each epitaxial protrusion portion of each grain is at least 20 mol %.

11. The silver halide photographic emulsion according to claim 7, wherein each epitaxial protrusion portion of each grain contains silver iodide, and the silver iodide content of each epitaxial protrusion portion of each grain is at least 10 mol %.

12. The silver halide photographic emulsion according to claim 11, wherein a silver iodide content of each epitaxial protrusion portion of each grain is at least 20 mol %.

13. A method of preparing a silver halide photographic emulsion in which at least 70% of the total projected area of silver halide grains contained therein is occupied by silver bromochloroiodide hexagonal epitaxial tabular grains each having (111) faces as main planes and an epitaxial protrusion portion, wherein the epitaxial protrusion portion exists on at least one apex portion of the hexagon, and, when an average silver chloride content of the epitaxial protrusion portions of all the grains having the epitaxial protrusion portion is expressed as CL mol %, a silver chloride content of each epitaxial protrusion portion of each grain falls within the range of 0.7 CL to 1.3 CL, and a silver chloride content of each epitaxial protrusion portion of each grain is 35 mol % or less, wherein the method comprises forming epitaxial protrusion portion by adding a silver iodide ultrafine grain emulsion prepared within 10 minutes or less of being added.

14. The method of preparing a silver halide photographic emulsion according to claim 13, wherein the silver chloride content of each epitaxial protrusion portion of each grain falls within the range of 0.8 CL to 1.2 CL.

15. The method of preparing a silver halide photographic emulsion according to claim 14, wherein each epitaxial protrusion portion of each grain contains silver iodide, and the silver iodide content of each epitaxial protrusion portion of each grain is at least 10 mol %.

16. The method of preparing a silver halide photographic emulsion according to claim 15, wherein the average equivalent circle diameter of the silver iodide ultrafine grain emulsion is 0.02 $\mu$m or less.

17. The method of preparing a silver halide photographic emulsion according to claim 13, wherein each epitaxial protrusion portion of each grain contains silver iodide, and the silver iodide content of each epitaxial protrusion portion of each grain is at least 10 mol %.

18. The method of preparing a silver halide photographic emulsion according to claim 17, wherein the average equivalent circle diameter of the silver iodide ultrafine grain emulsion is 0.02 $\mu$m or less.

19. A method of preparing a silver halide photographic emulsion in which at least 70% of the total projected area of silver halide grains, contained therein is occupied by silver bromochloroiodide hexagonal epitaxial tabular grains each having (111) faces as main planes and an epitaxial protrusion portion, wherein the epitaxial protrusion portion exists on at least one apex portion of the hexagon, and, when an average silver iodide content of the epitaxial protrusion portions of all the grains having the epitaxial protrusion portion is expressed as I mol %, a silver iodide content of each epitaxial protrusion portion of each grain falls within the range of 0.7I to 1.3I, and a silver chloride content of each epitaxial protrusion portion of each grain is 35 mol % or less, wherein the method comprises forming epitaxial protrusion portion by adding a silver iodide ultrafine grain emulsion prepared within 10 minutes or less of being added.

20. The method of preparing a silver halide photographic emulsion according to claim 19, wherein the silver iodide content of each epitaxial protrusion portion of each grain falls within the range of 0.8I to 1.2I.

21. The method of preparing a silver halide photographic emulsion according to claim 20, wherein each epitaxial protrusion portion of each grain contains silver iodide, and the silver iodide content of each epitaxial protrusion portion of each grain is at least 10 mol %.

22. The method of preparing a silver halide photographic emulsion according to claim 21, wherein the average equivalent circle diameter of the silver iodide ultrafine grain emulsion is 0.02 $\mu$m or less.

23. The method of preparing a silver halide photographic emulsion according to claim 19, wherein each epitaxial protrusion portion of each grain contains silver iodide, and the silver iodide content of each epitaxial protrusion portion of each grain is at least 10 mol %.

24. The method of preparing a silver halide photographic emulsion according to claim 23, wherein the average equivalent circle diameter of the silver iodide ultrafine grain emulsion is 0.02 $\mu$m or less.

* * * * *